US007329808B2

(12) United States Patent
Davis

(10) Patent No.: US 7,329,808 B2
(45) Date of Patent: Feb. 12, 2008

(54) STRING BENDING DEVICE FOR STRINGED MUSICAL INSTRUMENTS

(76) Inventor: Timothy Shane Davis, 105 Olivia Ct., Wilmore, KY (US) 40390

( * ) Notice: Subject to any disclaimer, the term of this patent is extended or adjusted under 35 U.S.C. 154(b) by 131 days.

(21) Appl. No.: 11/090,757

(22) Filed: Mar. 25, 2005

(65) Prior Publication Data

US 2006/0213350 A1 Sep. 28, 2006

(51) Int. Cl.
*G10D 3/00* (2006.01)

(52) U.S. Cl. ..... 84/313; 84/298; 84/299; 84/318

(58) Field of Classification Search ..... 84/313, 84/298, 299, 318, 319; D17/21
See application file for complete search history.

(56) References Cited

U.S. PATENT DOCUMENTS

| | | | | | |
|---|---|---|---|---|---|
| 1,924,854 | A | | 8/1933 | Harmon | |
| 2,196,531 | A | | 4/1940 | Larisch | |
| 2,741,146 | A | | 4/1956 | Fender | |
| 2,844,985 | A | | 7/1958 | Ferriera | |
| 2,998,742 | A | | 9/1961 | Pratt | |
| 3,479,917 | A | | 11/1969 | Zitnik | |
| 3,704,646 | A | * | 12/1972 | Davis et al. | 84/454 |
| 4,563,934 | A | * | 1/1986 | Keizer | 84/313 |
| 4,655,116 | A | | 4/1987 | Matsui | |
| 4,852,448 | A | | 8/1989 | Hennessey | |
| 4,951,543 | A | | 8/1990 | Cipriani | |
| 5,052,260 | A | | 10/1991 | Cipriani | |
| 5,056,397 | A | | 10/1991 | Leifheit | |
| 5,097,737 | A | | 3/1992 | Uhrig | |
| 5,198,601 | A | * | 3/1993 | McCabe | 84/298 |
| 5,208,410 | A | | 5/1993 | Foley | |
| 5,287,788 | A | * | 2/1994 | Hill, Jr. | 84/315 |
| 5,323,680 | A | | 6/1994 | Miller | |
| 5,467,679 | A | * | 11/1995 | Schmidt | 84/312 R |
| 5,567,897 | A | | 10/1996 | McEwen | |
| 5,955,689 | A | | 9/1999 | Feiten et al. | |
| 6,563,037 | B2 | | 5/2003 | Hamilton | |
| 2002/0112592 | A1 | | 8/2002 | Gillis | |

* cited by examiner

*Primary Examiner*—Renee Luebke
*Assistant Examiner*—Vanessa Girardi
(74) *Attorney, Agent, or Firm*—Stoll Keenon Ogden PLLC; James M. Francis

(57) ABSTRACT

A string bending device for stringed instruments and methods of use are claimed. The novel device permits the user to tension a string to change the pitch and tone by means of a tension arm and attached string pad. The string pad is unique in that it possesses an arcuate channel that acts as a string guide and promotes string life by gently bending the string along the arcuate channel and distributing pressure along a length of the string rather than at one point. The device may be repositioned during play so that other strings can be individually bent. The use of a plunger that may be easily disengaged and reengaged during the playing of the instrument allows the tension arm to easily be repositioned by sliding the tension arm along a rail system. Adjustable tension arm stops permit the user to predetermine the maximum tension that can be applied to each string.

20 Claims, 2 Drawing Sheets

STRING BENDING DEVICE FOR STRINGED MUSICAL INSTRUMENTS

BACKGROUND OF THE INVENTION

1. Field of the Invention

The field of the invention is a device for adjusting the string tension on a guitar or other stringed musical instrument.

2. Problems in the Art

Stringed musical instruments possess one or more tensioned strings stretched across a sounding board or other main body of the instrument which amplifies the audible vibration of the string. One end of the string is anchored at one side of the main body or sounding board and stretched across a bridge, the string then strung across the sounding board, and along an elongated neck portion attached to the main body. The other end of the string is then anchored at the end of the neck away from the main body to devices which permit individual or group adjustment of the string tension. At variously determined intervals along the neck portion are situated a plurality transverse ridges which underlie the plurality of strings. The strings vibrate due to physical manipulation, usually plucking or strumming with either fingers or an implement.

The sound emitted from a vibrated string is termed its pitch and is determined by the relationship of the tension of the string, its mass per unit length (which is a function of the string's diameter and composition), and the length of the string available for vibration, i.e. the effective length. The effective length of the string is the distance between a first anchor, called the bridge, attached at the head of the main body of the fretted stringed instrument, and a second anchor, called the string nut, attached at the far end of the neck. Typically the strings ride over a saddle which is immediately adjacent to the bridge. The effective length in which case then starts at the saddle and terminates at the distal end of the neck. At the distal end of the neck is the second string anchor, the string nut, through which all of the strings pass and contact immediately before they are attached to the tuning pegs. Various stringed instruments may not possess all of the aforementioned features but their principle of operation is similar.

A common method for changing the pitch is to temporarily shorten the effective length of the strength by pressing down upon one of the transverse ridges (frets). Since the only other variable that affects pitch that can be easily modified is tension, numerous innovations have sought to provide means with which to modify the tension to varying degrees of simplicity.

A popular innovation is the B-Bender which adjusts the tension on the B-string of guitars. Several variations on the B-Bender exist but the drawback is that only one string may be tensioned since the device is installed to affect only a single string and is not positionable so that different strings may be tensioned.

The most well known string bending device is described by U.S. Pat. No. 2,741,146, Tremolo Device for Stringed Instruments, by C. L. Fender (Apr. 30, 1954). The device is intended to allow the player of the instrument to vary the tension on a string by manipulation of a tremolo control arm which fits in the players palm and is incorporated in the bridge. The drawback to the Fender invention is that stretches all of the strings at once preventing the pitch adjustment of a single string while the permitting the remaining strings to be unaffected.

U.S. Pat. No. 3,479,917, Multiple Lever Manual Tone Changer For Guitars by Zitnik et al. (Nov. 25, 1969), describes using finger or palm operated levers to adjust the tension on guitar strings. Multiple strings can be affected only if multiple levers are installed.

Another innovation to adjust the tension of a guitar string is described in U.S. Pat. No. 5,567,897, Guitar Pull String Device, by McEwen (Oct. 22, 1996). McEwen describes a string tension adjustment device for electric guitars. The string tension is adjusted by means of a pull arm to which a shoulder strap is attached so that when the guitarist desires to activate the string tension adjustment device, he simply presses down on the neck of the guitar to pull the pull arm which in turn pulls a linkage mechanism that pulls or "bends" the string of the guitar that is coupled with the device. This method of tensioning a string is markedly different from the present invention in that it is not possible to change which string is affected while actually playing the instrument. Additionally, the present invention deforms the string while the McEwen invention stretches the string, this is expected to play a significant role in extending string life.

SUMMARY OF THE INVENTION

The present invention is a string tensioning device for musical instruments, particularly guitars, and more particularly electric guitars. Tensioning or bending the string changes the sound produced when a string vibrates by plucking, bowing, or strumming the string by finger, bow, or other implement. The device includes a slide rail support affixed to the instrument between the bridge and point of string affixation on the body. A tension arm is pivotably attached by a pivot screw that engages a yoke on a carriage assembly consisting of a carriage and carriage mount. A string pad with an arcuate channel string guide is affixed beneath the arm so that when the arm is properly aligned with the string to be tensioned, the string bends along the arcuate channel string guide of the pad as pressure is applied above the arm. The lack of sharp corners improves string life since no pinching of the string is necessary. The curvature of the arcuate channel also allows pressure to be more evenly distributed over a length of string rather than at a single point, this also allows for greater string deformation with less required force.

The tension arm affixed to the carriage mount by a pivot screw that engages a yoke moves with the carriage along the rail. The carriage mount is affixed by carriage mount screws to the top of a carriage that moves along the rail which is affixed by rail screws to a rail support that runs transverse to the strings. The tension arm stops also run transverse to the strings and allow a maximum tension to be reached by preventing the string pad from further depression against the strings. A carriage stop that engages the carriage notches prevents the carriage from inadvertently sliding along the slide rail while the instrument is being played also permits easy repositioning between strings while the instrument is being played.

The strings are bent or tensioned by applying pressure to the top of the tension arm and down onto the strings between the bridge and their point of attachment at the base of the instrument. The change in pitch is related to the amount of pressure applied to the string.

The tension arm with attached string pad is affixed to the slide rail system by the carriage in such a way as to permit the musician to reposition the carriage and tension arm while the instrument is being played. The slide rail support is notched so that it may receive a plunger affixed to the carriage onto which the string bending or tension arm is mounted, the benefit being that the arm can be fixably repositioned to match up with the appropriate string to be bent or tensioned yet be readily movable during play.

Accordingly, one skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially to including practitioners in the art who are not familiar with patent or legal terminology or phraseology, to determine quickly from a cursory inspection, the nature and essence of the technical disclosure of the application. The Abstract is neither intended to define the invention of the application, nor is it intended to be limiting to the scope of the invention in any way.

DETAILED DESCRIPTION OF THE INVENTION

Figure 1:
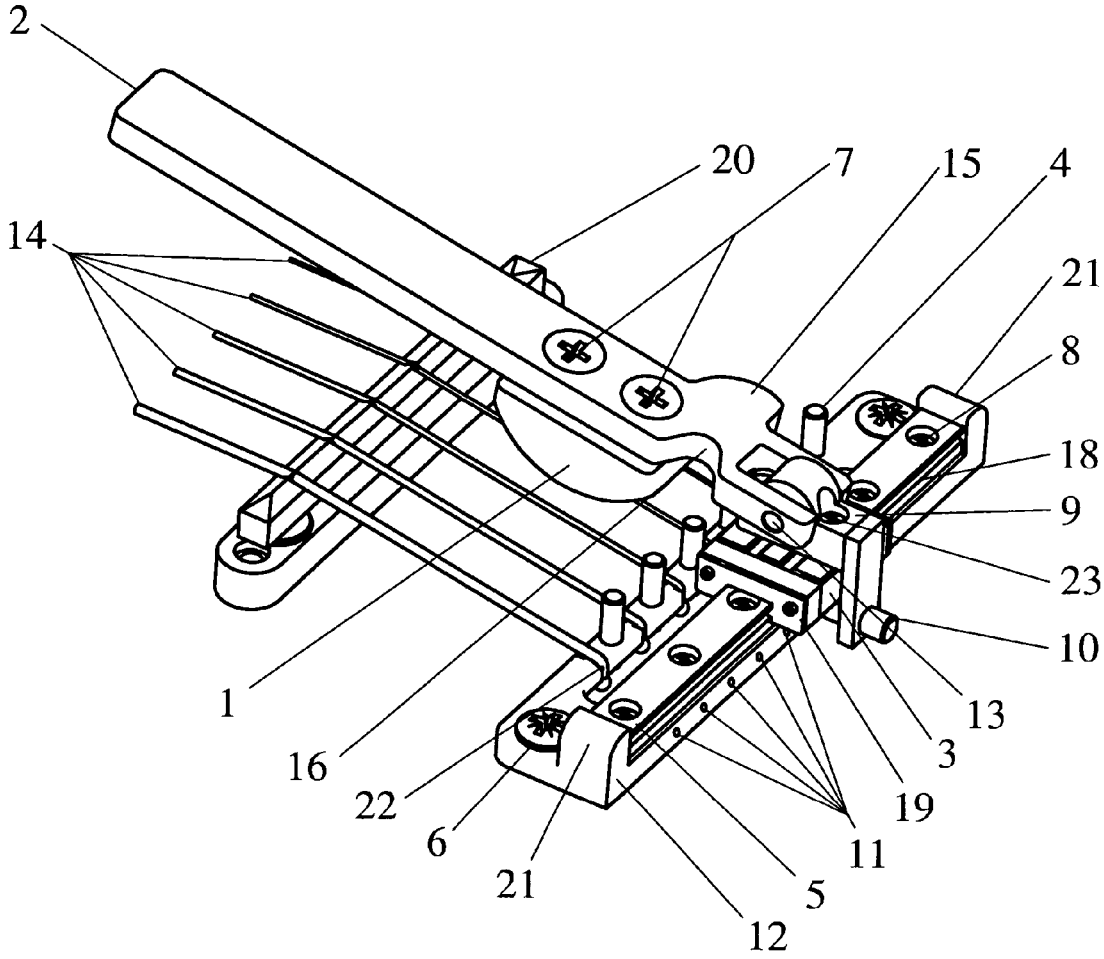
FIG. 1 is a partial perspective view of a typical electric guitar with the device of the present invention affixed below the bridge.

Referring to FIG. 1, the bridge 20 guides and supports the strings 14 on the body 11 between the present invention and the instrument neck. The string 14 passes through the slide rail support string guides 22 to be affixed in an appropriate manner. The string pad 1 is shown to engage the strings 14 from above and is affixed to the tension arm 2. The carriage 3 onto which the tension arm 2 is pivotably attached to the carriage mount 9. The carriage mount 9 is affixed to the top of the carriage 3 so that it moves with the carriage 3 as the carriage 3 slides along the slide rail 5.

The movement of the carriage 3 is aided by the use of ball bearings that are secured within the carriage 3 and against the slide rail 5 within the slide rail groove 18 by a ball bearing cap 19. The ball bearings engage the slide rail 5 by rolling along and within the slide rail groove 18 that runs the length of the slide rail 5. The slide rail 5 is affixed to the slide rail support 12 by numerous rail screws 8. The sliding of the carriage 3 is inhibited by the carriage stop 10 which engages stop notches 11 recessed into the slide rail support 12. The carriage stop 10 can be adjusted to various tensions to increase or reduce the required force to disengage the carriage stop 10 from the stop notches 11. Non-limiting examples of useful carriage stops 10 are spring loaded balls, spring loaded pins, and plunger screws. The movement of the carriage 3 is limited by the ball bearings to following the path formed by the slide rail groove 18 and is further limited to sliding only along the slide rail 5 by the slide rail support end tabs 21.

The tension arm 2 pivots or rotates about the pivot screw 13 that affixes the tension arm 2 to the carriage mount 9. The pivot screw 13 lies transverse to the strings 14 so that the tension arm 2 will rotate toward or away from the strings 14 about the pivot screw 13 in a manner typical of hinged joints. The pivot screw 13 can be adjusted to increase or decrease the resistance of the tension arm 2 to movement. The tension arm 2 is prevented from excessively depressing the strings 14 onto the neck of the guitar by a tension arm stop 4 which is optimally adjustable to desired heights. Each string 14 has its own tension arm stop 4 which may be independently adjusted apart from the other tension arm stops 4. Controllably adjusting the height of a tension arm stop 4 permits the pitch of the affected string to be further modified. The tension arm stop 4 engages the stop tab 15 on the tension arm 2. A stop gap 16 present on the opposing side of the tension arm 2 so that the appropriate tension arm stop associated with the engaged string 14 is the only tension arm stop 4 that engages the tension arm 2. The string bending device 100 is affixed to the guitar by two attachment screws 6 which pass through the slide rail support 12. The string pad 1 is affixed to the tension arm 2 by two pad screws 7.

As the tension arm 2 is depressed onto a string 14 the string is tensioned resulting in a change in tone when the string 14 is struck by a musician. The resulting change in pitch is related to the force applied by the tension arm 2 through the string pad 1. The musician has the ability to rapidly disengage the carriage stop 10, typically a plunger type apparatus, from a carriage stop notch 11, reposition the carriage 3 along the slide rail 5, and reengage the carriage stop 10 with another carriage stop notch 11 so that a different string 14 can be tensioned.

Figure 2:
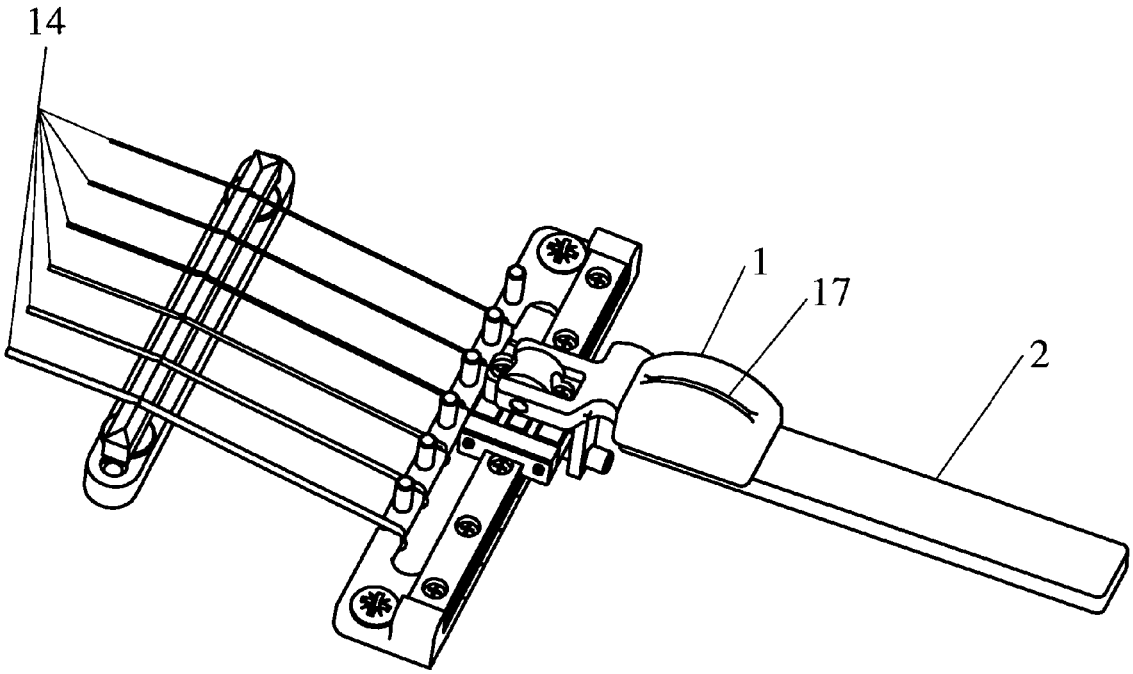
FIG. 2 is a perspective view of the device with the arm disengaged from the strings.

Referring to FIG. 2, the tension arm 2 is depicted as disengaged from the strings so that the underside of the tension arm 2 and the underside of the string pad 1 may be better viewed and understood. The string pad 1 is shown to have an arcuate channel string guide 15 that allows the affected string 14 to be gently deformed without pinching the string 14 against a sharp corner and effectively distributes the force along a length of the string 14 that engages the arcuate channel string guide 15 rather than at one point thus increasing the useful string 14 life.

What is claimed is:

1. A device comprising:

(a) a single tension arm for applying pressure to a musical instrument string, said tension arm possessing a means for tensioning at least one said string on said musical instrument;

(b) a carriage, onto which said tension arm is pivotably affixed;

(c) a slide rail onto which said carriage is slideably mounted so as to allow the tension arm to be repositioned from a point of engagement along a first string to a point of engagement along a second string;

(d) a slide rail support; and (e) means for temporarily affixing said carriage at a point along said slide rail; and (f) at least one tension arm stop which limits the deformation of a string by said tension arm.

2. The device of claim 1, wherein said at least one tension arm stop is adjustable to varying heights above said slide rail support.

3. The device of claim 1, wherein said carriage, slide rail, slide rail support, and tension arm are comprised of steel, brass, aluminum, titanium, or similar metals and alloys.

4. The device of claim 1, wherein said carriage, slide rail, slide rail support, and tension arm are comprised of graphite, kevlar, nylon, and similar composites.

5. The device of claim 1, wherein said means for tensioning at least one string on said instrument is a string pad affixed to said tension arm.

6. The device of claim 5, wherein said string pad has an arcuate channel.

7. The device of claim 5, wherein said string pad is comprised of the group of materials consisting of cork, wood, rubber, plastic, metal, metal alloys, or carbon based materials.

8. The device of claim 1, wherein said means for temporarily affixing said carriage is a plunger device that engages a notch in said slide rail support.

9. The device of claim 8, wherein said plunger device is a tensioned apparatus which resists disengagement from said notch.

10. The device of claim 8, wherein said plunger device is a plunger screw.

11. A device comprising:

(a) a single tension arm for applying pressure to a musical instrument string;

(b) a string pad affixed to said tension arm, said string pad having an arcuate channel string guide;

(c) a carriage, onto which said tension arm is pivotably affixed;

(d) a slide rail onto which said carriage is slideably mounted so as to allow a tension arm to be repositioned from a point of engagement along a first string to a point of engagement along a second string;

(e) a slide rail support; and (f) means for temporarily affixing said carriage at a point along said slide rail.

12. The device of claim 11, wherein said string pad is comprised of the group of materials consisting of cork, wood, rubber, plastic, metals, metal alloys, or carbon based materials.

13. The device of claim 11, wherein said carriage, slide rail, slide rail support, and tension arm are comprised of steel, brass, aluminum, titanium, or similar metals and alloys.

14. The device of claim 11, wherein said carriage, slide rail, slide rail support, and tension arm are comprised of graphite, keylar, nylon, and similar composites.

15. The device of claim 11, further comprising at least one tension arm stop affixed to said slide rail support.

16. The device of claim 15, wherein said at least one tension arm stop is adjustable to varying heights above said slide rail support.

17. The device of claim 11, wherein said means for temporarily affixing said carriage is a plunger device that engages a notch in said slide rail support.

18. The device of claim 17, wherein said plunger device is a tensioned apparatus which resists disengagement from said notch.

19. The device of claim 17, wherein said plunger device is a plunger screw.

20. The device of claim 17, wherein said plunger device includes a means for adjusting the resistance of said carriage to movement along said slide rail.

* * * * *